US011747076B2

(12) United States Patent
Khatri

(10) Patent No.: US 11,747,076 B2
(45) Date of Patent: Sep. 5, 2023

(54) REMOTE COOLING OF SUPER-CONDUCTING MAGNET USING CLOSED CYCLE AUXILIARY FLOW CIRCUIT IN A CRYOGENIC COOLING SYSTEM

(71) Applicant: Ajay Khatri, Bethlehem, PA (US)

(72) Inventor: Ajay Khatri, Bethlehem, PA (US)

( * ) Notice: Subject to any disclaimer, the term of this patent is extended or adjusted under 35 U.S.C. 154(b) by 539 days.

(21) Appl. No.: 16/996,098

(22) Filed: Aug. 18, 2020

(65) Prior Publication Data

US 2022/0057131 A1 Feb. 24, 2022

(51) Int. Cl.
*F25D 19/04* (2006.01)
*F25D 19/00* (2006.01)
*H01F 6/04* (2006.01)

(52) U.S. Cl.
CPC ..... *F25D 19/006* (2013.01); *F25D 19/04* (2013.01); *H01F 6/04* (2013.01)

(58) Field of Classification Search
CPC ..... F25D 19/006; F25D 19/04; H01F 6/04
USPC ..... 62/6
See application file for complete search history.

(56) References Cited

U.S. PATENT DOCUMENTS

| | | | |
|---|---|---|---|
| 3,188,822 | A | 6/1965 | Daunt |
| 3,423,955 | A | 1/1969 | Wright |
| 4,766,741 | A | 8/1988 | Bartlett et al. |
| 5,275,595 | A | 1/1994 | Dobak |
| 5,334,181 | A | 8/1994 | Rubinsky et al. |
| 5,520,682 | A | 5/1996 | Baust et al. |
| 6,070,414 | A | 6/2000 | Ross et al. |
| 6,442,948 | B1 | 9/2002 | Takeda |
| 10,684,047 | B2 | 6/2020 | Khatri et al. |
| 2002/0120258 | A1 | 8/2002 | Lalonde |
| 2009/0234345 | A1 | 9/2009 | Hon |
| 2011/0264084 | A1 | 10/2011 | Reid |
| 2012/0059364 | A1 | 3/2012 | Baust et al. |

(Continued)

FOREIGN PATENT DOCUMENTS

| | | | | |
|---|---|---|---|---|
| KR | 2019119923 A | * | 10/2019 | ..... F17C 13/087 |
| WO | 02/01123 A1 | | 1/2002 | |

OTHER PUBLICATIONS

Choi, Cryostat for Subcooler Mounted to an Outer Sample, 2019, Abstract (Year: 2019).*

*Primary Examiner* — Nael N Babaa
(74) *Attorney, Agent, or Firm* — Caesar Rivise, PC

(57) ABSTRACT

A remote cooling system of super-conducting magnets uses a closed cycle auxiliary flow circuit in a cryogenic cooling system. The super-conducting magnet is connected to the cryogenic cooling system via a flexible interface. This flexible interface has a rigid insert on its distal end and may be connected to a cryostat on its proximal side. The rigid end may be inserted in a mating cryogenic interface at the super-conducting magnet. The closed cycle auxiliary flow circuit allows the cryogenic cooled magnet to operate at its designed magnetic field strength and can keep the magnet operational at cryogenic temperatures for extended periods of time since no cryogenic fluid needs to be replenished. Such a system can have test samples raised to room temperature to make sample changes without any need to warm up the magnet. This makes sample change time and experiment turnaround time significantly shorter, and significantly increases productivity.

20 Claims, 6 Drawing Sheets

(56) References Cited

U.S. PATENT DOCUMENTS

| | | | | |
|---|---|---|---|---|
| 2013/0021032 | A1 | 1/2013 | Heiss et al. | |
| 2013/0047632 | A1 | 2/2013 | Rillo Millan et al. | |
| 2015/0346296 | A1* | 12/2015 | Biber | G01R 33/3815 62/51.1 |
| 2016/0298888 | A1* | 10/2016 | Khatri | F25B 9/02 |

* cited by examiner

REMOTE COOLING OF SUPER-CONDUCTING MAGNET USING CLOSED CYCLE AUXILIARY FLOW CIRCUIT IN A CRYOGENIC COOLING SYSTEM

FIELD OF DISCLOSURE

This invention relates generally to cryogenic cooling systems, and more particularly, to cooling of Super-Conducting Magnet that is remotely cooled using a closed cycle auxiliary cryogenic flow circuit in a cryogenic cooling system that uses a flexible interface.

BACKGROUND

Cryogenic cooling using liquid helium as cryogenic fluid has been used to cool super-conducting magnets to achieve high magnetic fields. In multiple applications in the field of physics, chemistry, etc. super-conducting magnets are employed to study properties of materials under investigation (e.g., samples). This traditional approach of cooling magnet with liquid helium is both expensive and logistically difficult. Systems that require frequent sample changes, especially when a sample needs to be at cryogenic temperature, make using such equipment difficult because super-conducting magnets need to be warmed up to room temperature every time a sample needs to be changed. This involves many hours of lost experimental time, significant expense of cryogenic fluid and logistical inconvenience. Additionally this is open cycle for liquid cryogen such as helium so once used it is not available for further use.

To overcome the difficulties described above, the inventor understands a closed cycle cryocooler can be employed. Such a cryocooler is attached to the super-conducting magnet either directly or with high thermal conductivity copper or aluminum braids. This allows the magnet to cooldown to cryogenic temperature range (e.g., from about −150° C. (−238° F.) to absolute zero (−273° C. or −460° F.)) In this case no liquid cryogen, such as helium, is required. Further, the cryocooler is in close proximity of the magnet, requiring significant space in the experiment area. This has drawbacks, for example, introducing vibrations from the cryocooler into the magnet and the experiment. This is of great concern where vibration cannot be tolerated in making sensitive measurements. It also has a drawback that if the object under study needs to be at cryogenic temperature, a separate cryocooler needs to be employed to cool the sample. This is quite expensive and the cryocooler needs to be in close proximity of the experiment, which makes conducting the experiment very bulky and difficult to operate. If the same cryocooler is used to cooldown the sample under study, then during every sample change the super-conducting magnet needs to be warmed up to room temperature, which means a loss of many hours of experimental time. Productivity is significantly reduced.

In order to overcome the difficulties and shortcomings of present systems and technologies employed in cooling a super-conducting magnet, a different concept is proposed for the cooling of such a magnet.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a system for cryogenic cooling of a remote cooling target. The system includes a cryostat partially housing a cooling circuit that provides cooled fluid, a flexible interface connected to the cryostat at a proximal end of the flexible interface and extending to a distal end, a target having a housing configured to hold a test sample, with the target connected to the distal end of the flexible interface and the target configured to cycle the cooled fluid from the cryostat within the target housing to cool the target and the test sample to cryogenic temperatures less than 30K, wherein the test sample may be warmed to room temperature while remaining held in the target while the target maintains operation at the cryogenic temperatures less than 30K.

According to aspects described herein, an exemplary remote target for cryogenic cooling of a test sample is described. The exemplary remote target includes a flexible interface having a first end and a second end opposite the first end, with the first end configured to connect to a cryostat and extend to the second end. The cryostat partially houses a cooling circuit that provides cooled fluid. The exemplary remote target also includes a super-conducting magnet unit having a housing configured to hold the test sample. The super-conducting magnet unit is connected to the second end of the flexible interface and is configured to cycle the cooled fluid from the cryostat within the housing to cool the super-conducting magnet unit and the test sample to cryogenic temperatures less than 30K. The test sample may be warmed to room temperature while remaining held in the super-conducting magnet unit while the super-conducting magnet unit maintains operation at the cryogenic temperatures less than 30K.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
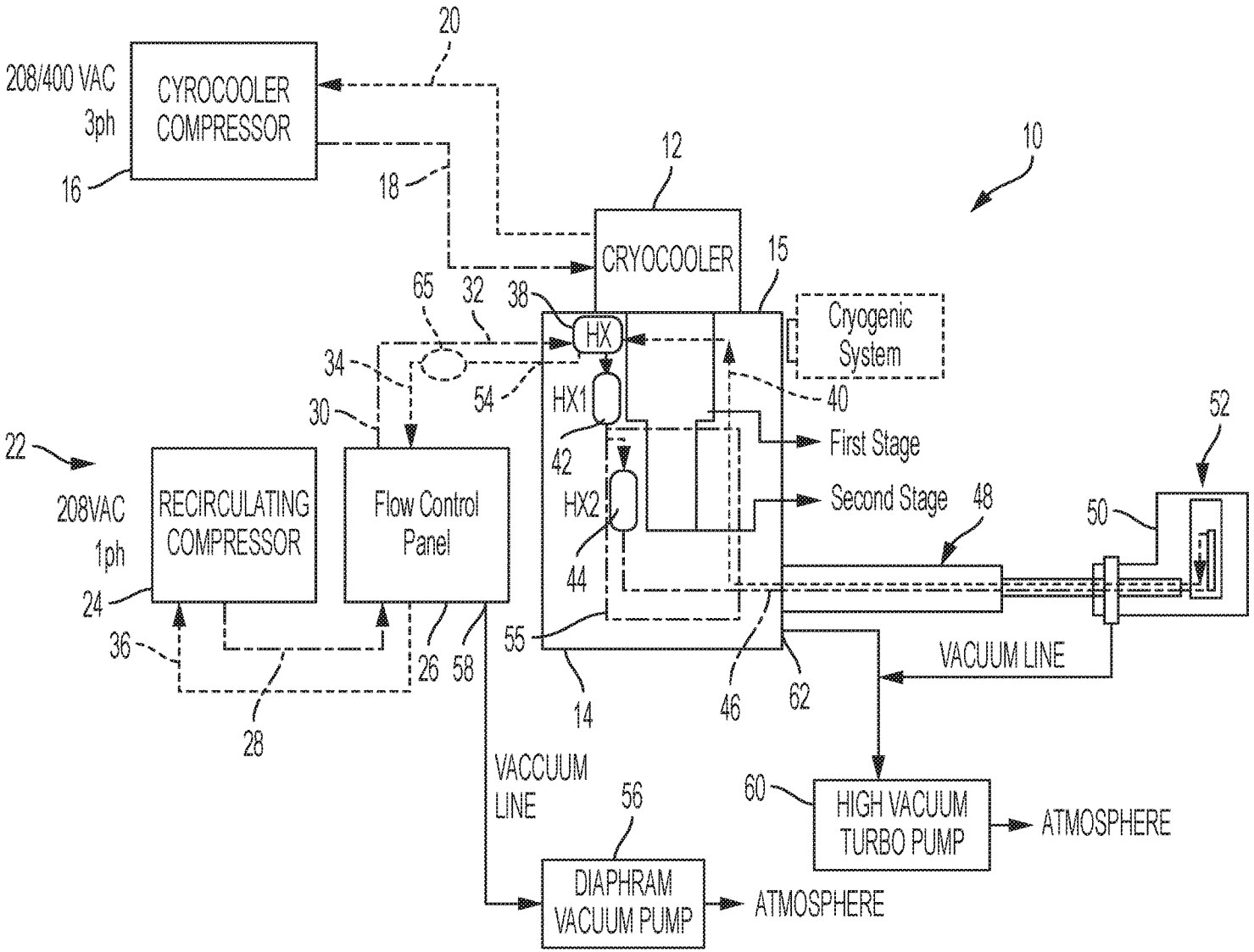
FIG. 1 is a schematic view of a cryogenic cooling system in accordance with examples of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Examples of the present invention include a system of remote cooling of a remote target (e.g., super-conducting magnet, cold-head, test sample) using a closed cycle auxiliary flow circuit including a cryogenic cooling cryostat configured to connect to a flexible interface. In such a system the target is located a significant distance away from the cryogenic cooling cryostat. The target is connected to the cryogenic cooling cryostat using a flexible interface. This flexible interface is a conduit having separate flow channels to transfer fluid a first direction from the cryostat to the target and a second or return direction from the target to the cryostat. The flexible interface may have a rigid insert at a distal end thereof connected to the target, and a flexible coupling at a proximal end thereof that may be connected to the cryostat. The rigid insert section of the flexible interface may be inserted in a mating cryogenic interface at the target.

For a target that is a super-conducting magnet, such an arrangement allows the magnet to cooldown to cryogenic temperature of about 4K, where the magnet becomes super-conducting and creates intense magnetic field. This allows the magnet to operate at a designed magnetic field strength greater than at room temperature. Since the magnet is physically located remotely from the cryogenic system, the experiment space is opened up and makes operation much easier. The magnet may be considered remote from the cryogenic system when separated (e.g., up to 3 meters, from about 0.5 to 5 m, greater than about 1 m) from the cryogenic system. This also limits vibration introduced by the cryogenic system to be well below one micron and typically in a few nanometer ranges in magnitude compared to several tens of microns when cryocooler is directly attached to the magnet. Such a closed cycle system can keep magnet at cryogenic temperature and operational for long period of time since no cryogenic fluid such as liquid helium needs to be replenished. Such a system can have test sample that can be raised in temperature to room temperature to make sample change without any need to warm up magnet. This makes sample change time and experiment turnaround time significantly shorter, and significantly increases productivity of a researcher or user.

Other examples of the system may use multiple flexible interfaces attached to the single common cryogenic system. While not being limited to a particular arrangement, in examples a flexible interface may be connected to a remote super-conducting magnet and another flexible interface may be connected to another remote device, such as a cold-head that houses a sample for investigation. Such arrangement allows a cold-head to be removed from the magnet bore for quick sample change while the magnet stays at cryogenic temperatures. As the cold-head is attached to a flexible interface it can be easily manipulated for such operation.

FIG. 1 depicts an exemplary cryogenic cooling system 10. The cryogenic cooling system 10 is shown including a cryostat 15 and cryocooler 12 at least partially housed in a sealed vacuum housing 14, which provides vacuum enclosure for the cryocooler. The cryocooler 12 is cooled by a compressor 16 having a compressor supply line 18 and a compressor return line 20 connected to the cryocooler. Cryogen (e.g., helium) may be supplied to the cryocooler 12 from a source 22, such as a recirculating compressor 24 or helium container (not shown) via a flow control panel 26 (e.g., pressure regulator) that may regulate the rate of the cryogen supply to the cryocooler. A benefit of the use of a fully closed recirculating helium circuit is in permitting the use of recirculate cooled helium, thereby reducing a need for costly, external high purity helium gas or liquid helium supplies.

The cryogen passes from the cryogen source 22 via supply lines 28, 30, which may be flexible, to an inlet 32 of the cryocooler. As illustrated, the cryogenic cooling system 10 may employ a closed loop auxiliary circuit, wherein return flow is supplied via recirculate return lines 34, 36 the recirculating compressor 24, which may again supply the returned cryogen to the cryocooler 12.

The cryocooler 12 may be connected to single or multiple independent cryogenic fluid flow paths that employ heat exchangers physically attached to its first and second cold stages. These heat exchangers, which may be of various known types such as tube in tube or matrix counter flow heat exchangers, provide cooling to high pressure (e.g., about 20 psia to 330 psia) and low-pressure (e.g., below 20 psia)

auxiliary flows. For the fluid flow paths, high-pressure helium (e.g., about 20 psia to 330 psia) flow is supplied to inlet 32 of the cryocooler 12. The helium gas from cryogen supply line 30, which may be room temperature or other temperature warmer than cryogenic temperatures, passes through a counter-flow heat exchanger 38. The counter-flow heat exchanger 38 cools the gas from its warmer temperature to a pre-cooled intermediate lower temperature (e.g., as low as about 60K) by using the cooling power of colder low-pressure gas flow returning from return line 40. The low pressure can be below 20 psia.

The pre-cooled gas then passes through first heat exchanger 42, which is in direct thermal contact with a first stage of the cryocooler 12. The helium gas is cooled further via this stage to about a first stage temperature of the cryocooler 12 ranging from about 30K to 100K. The gas then passes through second heat exchanger 44, which is in direct thermal contact with the second stage of the cryocooler 12 that may be at the lowest temperature that the cryocooler can achieve. Here, the gas is cooled to a temperature at least very close to the second stage temperature of the cryocooler typically ranging from about 4K to 25K. Thus the cryocooler 12 provides cooling at the first and second stages of the cryocooler.

The cooled gas continues within flexible supply line 46 to a flexible interface 48 and is delivered to a super-conducting magnet unit 50 and/or target test sample 52. The rigid end of the flexible interface is inserted in the magnet to cool the test sample under study to a cryogenic temperature. Low pressure return flow 34 of cold gas returning after cooling the super-conducting magnet unit 50 flows back through the flexible interface 48 via the return line 40 back into the gas return part of the helium circuit in the cryocooler section. There it provides cooling to the incoming warmer high pressure helium in the counter-flow heat exchanger 38 and exits via return flow outlet 54. While the cryogenic cooling system 10 is shown having one port for coupling with the flexible interface 48, it is understood that the cryogenic cooling system or vacuum housing 14 thereof may have a plurality of ports for coupling with a plurality of flexible interfaces, as described in better detail below.

The cryogenic cooling system 10 can employ a single or multiple closed cycle auxiliary cooling circuits. Each of these cooling circuits may provide cold cryogenic fluid to remote cooling target (e.g., super-conducting magnet unit 50, test sample 52). Each auxiliary cooling circuit may use an additional or share existing recirculation compressor 24, flow control panel 26, cryogen supply and recirculate return flexible hoses 28, 36 between the recirculating compressor and the flow control panel, cryogen supply hose 30 and return flexible hose 34 connecting the flow control panel to cryostat 15 within the cryostat vacuum housing 14, at least one flexible interface 48 attached to the cryostat on one side of the flexible interface and to a target to be cooled on the other side of the flexible interface.

High-pressure flow is delivered by the recirculating compressor 24 to the flow control panel 26 via flexible hoses (e.g., cryogen supply line 28, flexible recirculate return line 36). From the flow control panel 26 the high-pressure gas flow is delivered to the high-pressure inlet 32 of the cryostat. The supply pressure can be in the range of 20 psia to 330 psia. The gas flow then passes through the heat exchangers 38, 42, 44 attached to the cryocooler. From there it passes through the cryostat 15 and the high-pressure delivery tube of the flexible cold fluid discharge interface 48. The fluid flow may then undergo expansion (e.g., Joule-Thompson (JT)), thus reducing in pressure and then cool the target attached to the distal end of the flexible interface. After cooling the target, low-pressure flow returns through the flexible interface 48 back to the cryostat 15. The flow exits the cryostat via the return flow outlet 54, and continues within a flexible hose (e.g., recirculate return line 34) to the gas flow control panel manifold 26. From the flow control panel, flexible hose recirculate return line 36 returns the fluid flow back to the recirculating compressor 24. Thus the auxiliary cooling circuit is fully closed.

A radiation shield 55 is attached to the cryocooler 12 such that it envelopes the output of the first heat exchanger 42, the second heat exchanger 44, flexible supply line 46, and extends beyond the second stage of the cryocooler. An exemplary cryogenic system is discussed in U.S. Publication No. US-2016-0298888-A1, the contents of which are incorporated herein by reference in its entirety.

The cryogenic cooling system 10 may also employ vacuum pump 56 on an outlet end 58 of the flow control panel 26, and a high vacuum pump 60 on an exhaust side 62 of the cryocooler 12. Vacuum pump 56 is employed to evacuate the auxiliary flow circuit from the flow control panel 26 to the target. This eliminates contamination when high purity helium starts flowing during operation. High vacuum pump 60 creates high vacuum level in the vacuum housing 14, flexible interface 48 and housing covering the magnet 50 as well as test sample 52. One can also employ a dry vacuum pump 65 near the return flow outlet 54. The exhaust of this oil less pump is then connected to the recirculate return line 34. This permits a reduction of pressure on the exhaust side, and at a remote sample location. This results in even lower temperature at the sample 52, potentially below 3K, as opposed to operation without use of the vacuum pump wherein temperature of about 4.2K (liquid helium temperature at normal atmospheric pressure) has been achieved during tests.

Figure 2:
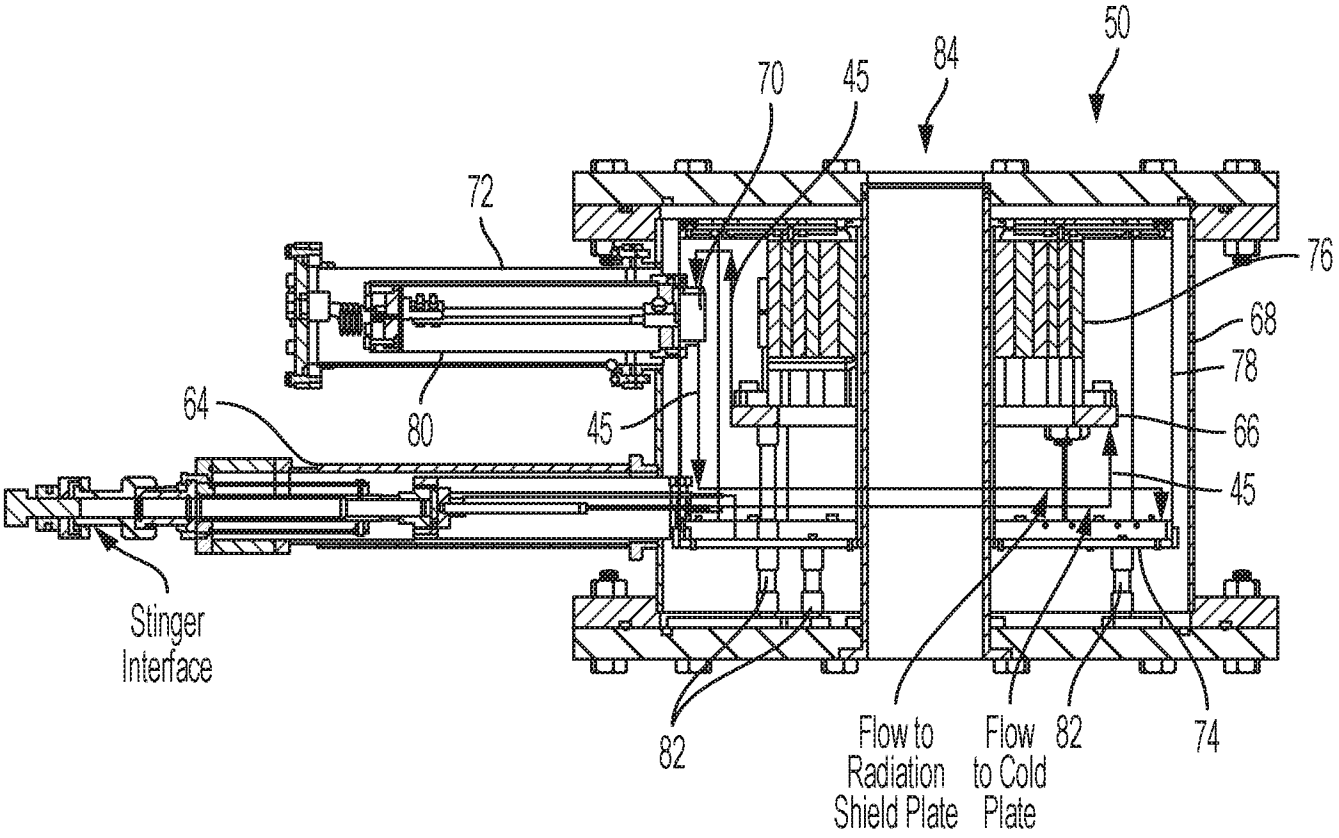
FIG. 2 is a side view in cross of an exemplary super-conducting magnet unit.

FIG. 2 depicts the super-conducting magnet unit 50 in cross section with a cryogenic fluid flow path within the magnet unit. The cold cryogen fluid may flow as cold flow within conduits shown as lines 45. For example, the flow path may proceed within a conduit made of copper or stainless-steel tubing. Cold cryogenic fluid is supplied from the flexible interface 48 via a cryogenic interface 64 first to cold plate 66 in a magnet housing 68. The conduit lines 45 may wrap around the cold plate 66, for example in a coil like manner, to cool the cold plate with the cryogenic fluid within the conduit line. After cooling the cold plate 66, cryogenic flow goes to a cooling puck 70 attached to super-conducting current leads 72. The cooling puck 70 may have a cylindrical body extending to a flange and may be made of copper or aluminum. The conduit lines 45 may wrap around the cooling puck 70 in a coil like manner to cool the cooling puck with the cryogenic fluid within the coiled conduit. After cooling the super-conducting current leads 72, cryogenic flow is directed to the radiation shield plate 74. After cooling the radiation shield plate, flow re-enters the flexible interface 48 of the cryogenic cooling system 10 and returns back to the cryocooler 12.

It is understood that the cryogenic flow path is not limited to progress in the order described above, as it may also be possible to direct flow in any order within the magnet housing 68. For example, it is also possible to direct flow from the cold plate 66 to the radiation shield plate 74 and then to the cooling puck 70 on the super-conducting current leads 72.

The super-conducting magnet unit 50 may include the magnet housing 68 with all it houses, and the current leads 72 and cryogenic interface 64 as needed for operation with the cryostat 15 via flexible interfaces 48. In particular, the super-conducting magnet unit 50 includes magnet 76 mounted on the cold plate 66 and mechanically clamped with the cold plate to provide cooling. A radiation shield 78 is mounted on the radiation shield plate 74 such that it envelopes the magnet completely. It may also provide an approach to connect the super-conducting current leads 72 to the cooling puck 70, as understood by a skilled artisan. The cooling puck 70 may thus be connected to a radiation shield shell 80 in the current leads assembly. The super-conducting leads are cooled through this radiation shield shell to a super-conducting temperature of less than 80K required for the current leads. The radiation shield plate 74 and radiation shield 78 may be made of aluminum.

The magnet housing 68 is also a vacuum housing that envelopes the magnet 76 and radiation shield assembly (e.g., radiation shield plate 74, radiation shield 78) and provides an approach to connect with mating cryogenic interface 64 for the cold cryogenic fluid and also for the super-conducting current leads 72. It also houses the support structure 82 (e.g., columns) which may be made of thermally insulating material such as G-10, Ceramic, etc. for the magnet 76 and radiation shield 78. A magnet bore 84 is shown coaxially disposed within the magnet 76 and radiation shield 78.

Figure 3:
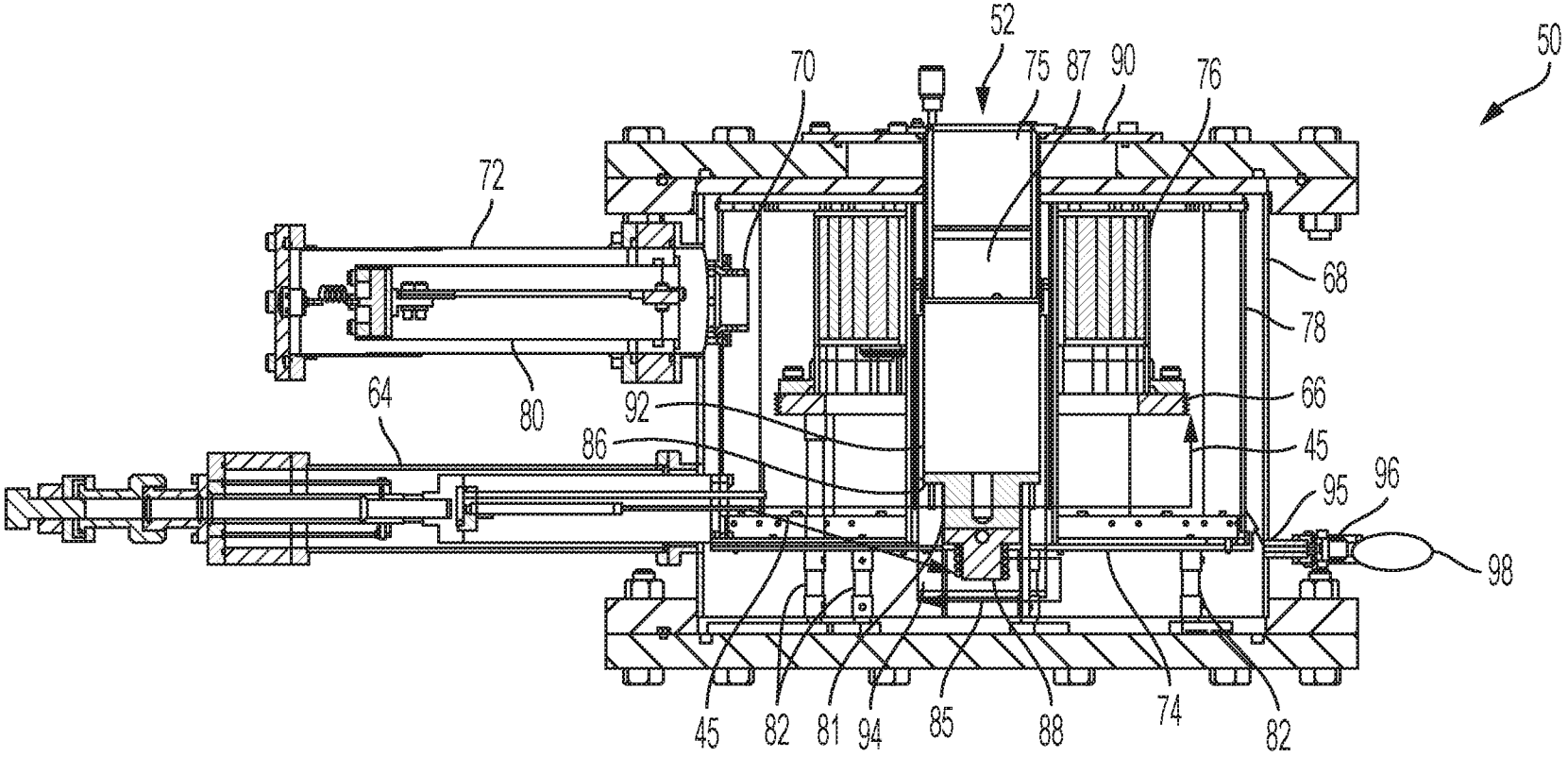
FIG. 3 is a side view in cross of an exemplary super-conducting magnet unit and integrated sample chamber shell.

FIG. 3 depicts the super-conducting magnet unit 50 in cross section integrated with a sample chamber shell 86 having independent sample heating and cooling. In this example, the magnet bore 84 houses the independent sample chamber shell 86 concentric to the magnet bore. Cold cryogenic fluid is supplied from the flexible interface 48 to the super-conducting magnet unit 50 in a manner as described above. The cold cryogen fluid flow may be split within the magnet housing 68 into a plurality of flows shown as conduit lines 45. A first flow proceeds to and about the cold plate 66 as shown, for example, in FIG. 2. A second flow splitting from the first flow goes to a sample cooling puck 88 located adjacent a cold interface base 81 of the sample chamber shell 86. The sample cooling puck 88 may be similar to cooling puck 70. For example, the sample cooling puck 88 may have a cylindrical body extending to a flange for coupling to the cold interface base 81, and may be made of copper or aluminum. Conduit line 45 may wrap around the sample cooling puck 88 in a coil like manner to cool the sample cooling puck with the cryogenic fluid within the coiled conduit line.

As can be seen in FIG. 3, the sample cooling puck 88 is attached to the cold interface base 81 of the sample chamber shell 86, for example, via bolts or other fasteners (not shown) through the flange of the sample cooling puck and into the base. The cold interface base 81 may be made of copper or like material and may support the sample directly or indirectly via a support plate (not shown) or other intermediate member in the sample chamber shell 86. The cold interface base 81 may also have a cylindrical body extending to a flange for coupling to the cylindrical sidewall 92 of the sample chamber shell 86, for example, with bolts or other fasteners through the flange of the cold interface base into the sidewall.

The sample chamber shell 86 includes a sample chamber cover 75 that may attach to the sample chamber directly or indirectly through an intermediate member, for example, an upper radiation shield 87. While not being limited to a particular material, in FIG. 3 the upper radiation shield 87 may be a transparent or other optical member or cylindrical window that may permit a user to see through the upper radiation shield to visibly inspect the target. The sample chamber cover 75 is shown as an integrated member including a see-through transparent cylindrical optical member extending from the upper radiation shield 87 to flange 90, which interfaces with and attaches to the magnet vacuum housing 68. The sample chamber shell 86 may include the sidewall 92 that with the cold interface base 81, the upper radiation shield 87 and the cover 75 form the cylinder body of the sample chamber. This sample chamber shell 86 may be independently evacuated through a pump out tube (not shown) that may be connected from base of sample chamber shell 86 to the magnet housing 68. A radiation shield 94 encloses the cooling puck 88 and the sample chamber shell 86. The radiation shield 94 is attached to a cold plate 85 at the bottom of the radiation shield 94, as well understood by a skilled artisan.

As noted above, the cold flow that is split on entry is directed to the cooling puck 88 of the sample chamber shell 86. After the cooling puck, the cold flow cools the cold plate 85 at the bottom of the radiation shield 94 thereby cooling the radiation shield connected to the sample chamber shell. After cooling the radiation shield, the cold flow is directed to flow through an exhaust tubing (not shown) to exhaust port 95 out of the magnet housing 68. On the outside of the magnet housing 68 a flexible hose 96 is connected from the exhaust port 95 to a flow control valve 98 in the flow path. The exhaust flow is then returned to the flow control panel 26, for example, as described above. This routing of the cold flow forms the closed flow path for the cooling puck 88 part of the cold flow circuit. This flow to the cooling puck 88 may be regulated by controlling the opening of the flow control valve 98 located along the flow path.

To cooldown the sample cooling puck 88, the flow control valve 98 may be opened. Cold flow cools down the cooling puck and radiation shield 94, and then exits through the associated plumbing or tubing to the flexible hose 96. In order to warm the sample chamber shell 86 without warming up magnet 76, the valve 98 may be closed. This closure ceases cold flow through the sample chamber shell 86. Heat, for example, from an electrical heater (not shown) may be applied to the chamber shell 86, thus bringing the chamber shell to a temperature above the cold flow temperature, and eventually to room temperature.

During an exemplary operation of the super-conducting magnet unit 50, a user may open sample chamber cover 75, thermally attach a sample under study to the bottom of the sample chamber shell 86 and reinstall the sample chamber cover on the sample chamber. As noted above, the sample chamber cover 75 may include a window for observation of the sample from above the magnet unit 50. The user may evacuate the sample chamber using, for example, a vacuum pump, and then start the cryogenic system to cool the super conducting magnet and sample chamber as described above.

Once an experiment or operation is completed, the user may apply an electrical heater installed on the sample chamber base and raise the sample chamber temperature to room temperature. The magnet remains cold and super conducting during this time. Then the user or researcher can open the sample chamber cover 75 and access the sample 52. The user or researcher can then change to a next sample and start the process again. This ability to change samples without affecting the magnet 76 temperature makes operation of the cryogenic cooling system 10 easier and eliminates a need to bring the magnet to room temperature in order to change samples, thus saving up to hours of down time and increasing productivity.

Figure 4:
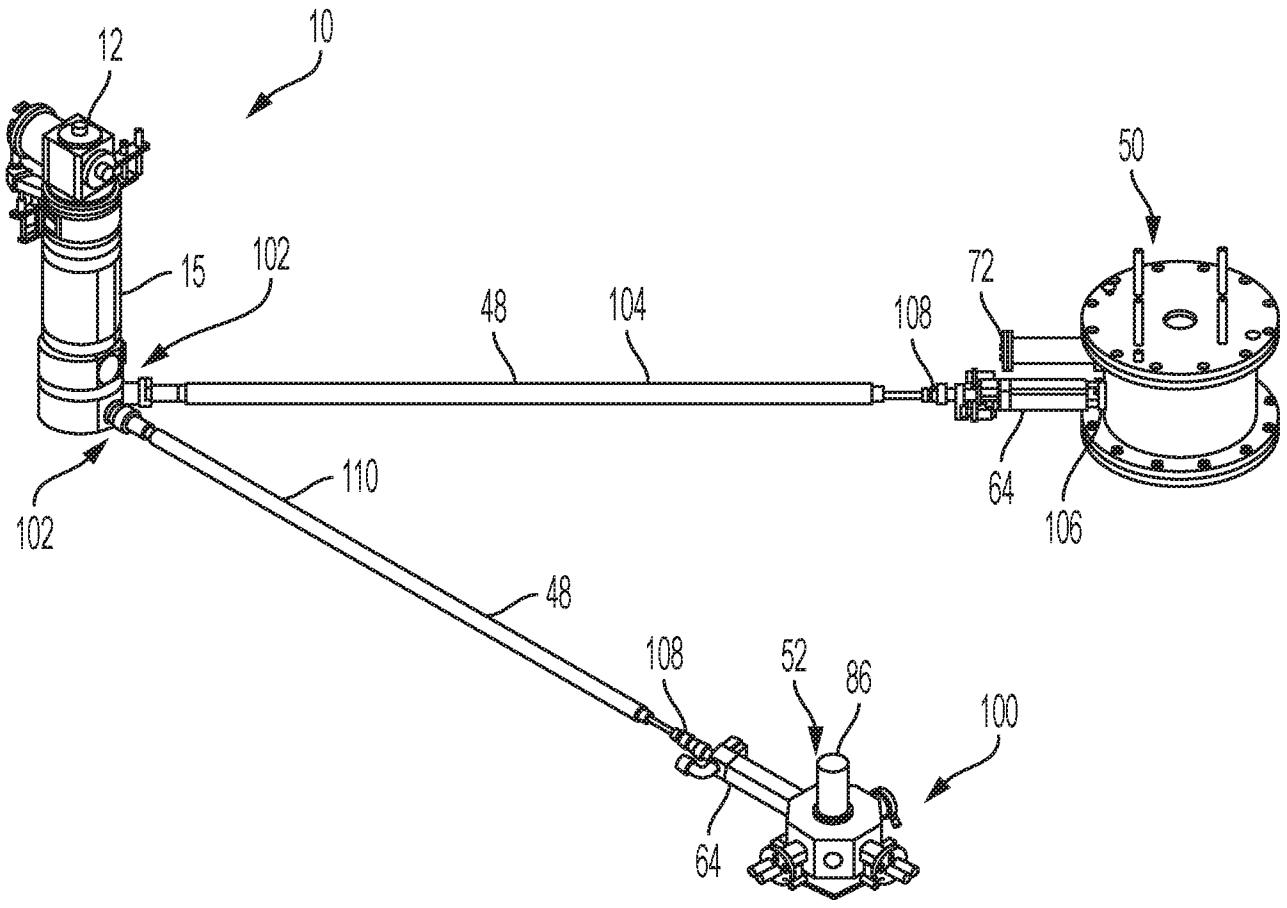
FIG. 4 is a perspective view of an exemplary cryogenic cooling system having multiple targets.

FIG. 4 is an exemplary schematic of cryogenic component layout with multiple flexible interfaces attached as part of the cryogenic cooling system 10. In this example, a flexible interface 48 is attached to super-conducting magnet unit 50 and another flexible interface 48 is coupled to cold-head 100 with a target test sample 52 inside. In particular, the first flexible interface 104 of the plurality of flexible interfaces 48 is coupled to the cryogenic connection port 106 of the super-conducting magnet unit 50 via cryogenic interface 64 and cryogenic insert connection 108. The second flexible interface 110 of the plurality of flexible interfaces 48 is coupled to the cold-head 100 via another cryogenic interface 64 and cryogenic insert connection 108. The cryogenic cooling system 10 is shown having a plurality of ports 102, with respective ports coupled to the flexible interfaces 48.

The super-conducting magnet unit 50 and cold-head 100 can be cooled simultaneously or independently from each other. The super-conducting magnet may be cooled as described above by connecting the magnet unit 50 to flexible interface 104. The cold-head may be cooled by an independent stream of the cryogenic flow supplied from the common cryogenic cooling system 10 through the second flexible interface 110. The cold-head 100 includes a housing configured to hold a sample chamber shell 86 or test sample 52 attached to a cold tip (not shown) inside the cold-head for cooling of the sample, as understood by a skilled artisan.

Since the super-conducting magnet unit 50 can be cooled independently in this configuration, the test sample 52 inside the cold-head 100 can be warmed up to room temperature and test samples can be change without having to warm up the magnet. This is beneficial, for example, for research since significant down time is involved in warming up the magnet to room temperature and then cooling it down to cryogenic temperatures. This ability to change test samples without changing magnet temperature increases productivity significantly.

Figure 5:
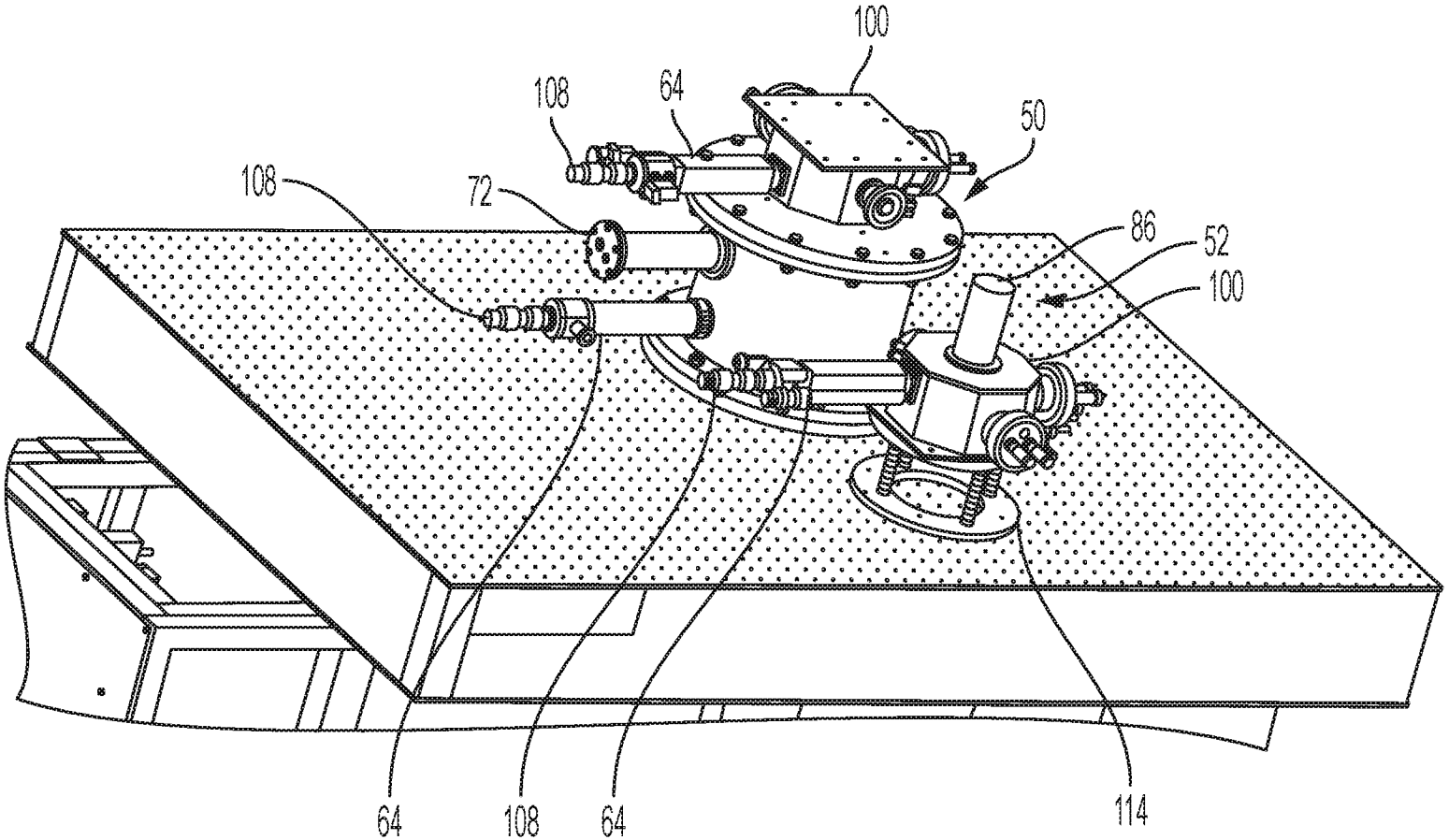
FIG. 5 is a perspective view of exemplary targets useable with an exemplary cryogenic cooling system.

FIG. 5 shows the cold-head 100 integrated with the super-conducting magnet unit 50 and also separated from the magnet for sample 52 changes. This is possible as cryogenic flow from the cryocooler 12 is in fluid communication with both the super-conducting magnet and the cold head 100 simultaneously via the flexible interfaces 48 (FIG. 4).

FIG. 5 shows cold-heads 100 in two different positions. In a testing position a cold-head 100 may be installed on the super-conducting magnet 50 during experiments. It may be held in position with appropriate support structure (not shown). The design of the cold-head 100 is such that the sample is located in the magnet bore 84 typically at the point of maximum magnetic strength during the experiment. Once experiments of the test sample 52 in the cold-head 100 are completed, the cold-head may be removed from the top of the magnet unit 50, flipped over and placed to the side, for example, on platform 114. This is possible because the flexible interface 48 allows the cold-head 100 to be manipulated in different positions without disconnecting the cold-head. In this position it is easy to access the sample and make sample changes, for example as described above. After a sample change, cold-head 100 may again be placed on the top of the magnet unit 50 for testing or other experiment.

Figure 6B:
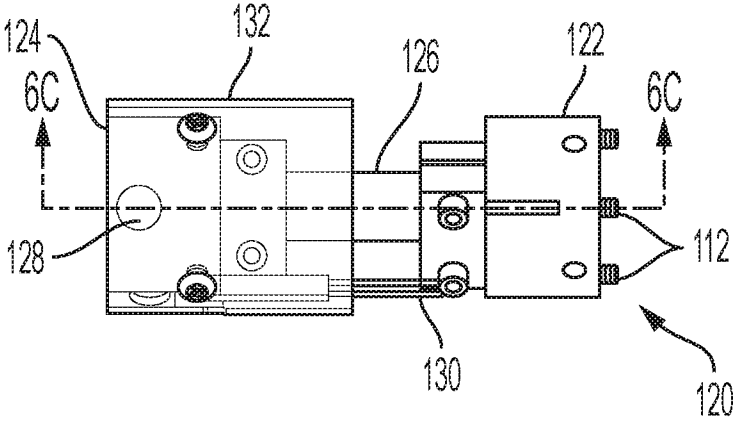
FIG. 6B is a top view of the exemplary 800K interface mount.
Figure 6D:
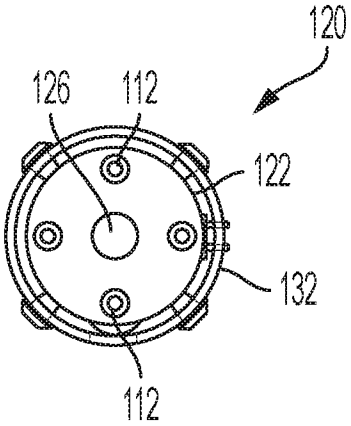
FIG. 6D is a first side view of the exemplary 800K interface mount.
Figure 6C:
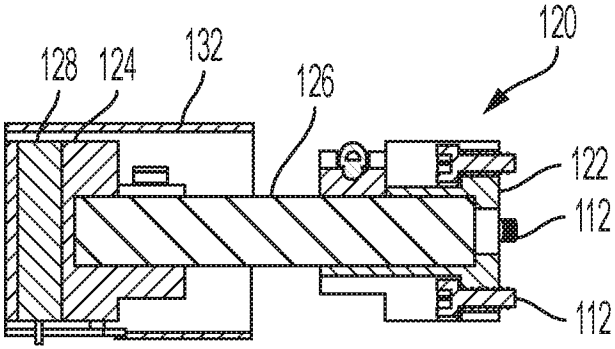
FIG. 6C is a sectional view along C-C of the exemplary 800K interface mount shown in FIG. 6B.
Figure 6A:
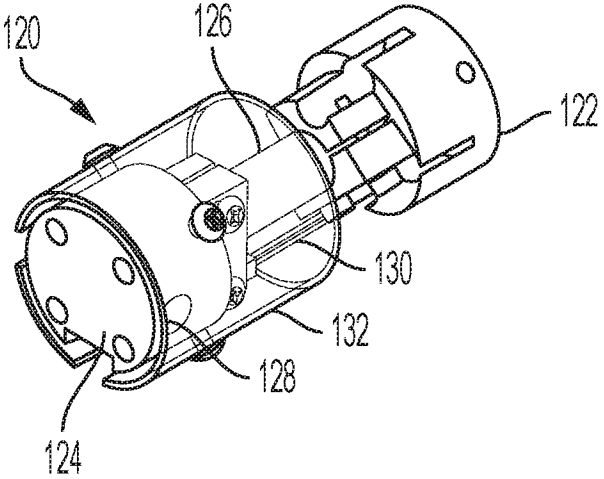
FIG. 6A is a perspective view of an exemplary 800K interface mount.
Figure 6E:
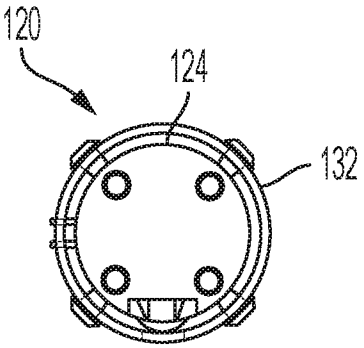
FIG. 6E is a second side view of the exemplary 800K interface mount.

In addition, the temperature of the test sample 52 can be raised up to about 800K so the sample can be studied in a temperature range of about a 3K to 800K while still integrated with the super-conducting magnet unit 50. FIG. 6A-6E depicts an exemplary structure of an 800K interface mount 120 in various views. For example, the interface mount 120 may be inserted between the cold interface base 81 and a sample 52 within the sidewall of the sample chamber shell 86 for observation of the sample at temperatures above cryogenic temperatures. At a first end of the mount, a cold side 122 may be connected to the cold plate that is at cryogenic temperature. In the example depicted in FIG. 3, cold side 122 may be installed on cold interface base 81 of the sample chamber shell 86, for example with bolts 112 (FIGS. 6B-6D) or other appropriate fasteners to secure the cold side to the base. At a second end opposite the first end, a sample side 124 may be used to mount a sample 52 whose temperature may be varied from 3K to 800K. The sample may rest on a Petrie dish or other type of sample culture plate (not shown). As can be seen in FIGS. 6A and 6E, the sample side 124 has threaded mounting holes to mount a culture plate holding the test sample with appropriate hardware, as well understood by a skilled artisan.

A thermal isolator 126 is employed axially concentric with the cold side 122 and sample side 124 to connect the first and second ends. An electrical heater 128 is located at the sample side 124 of the interface mount 120. The interface mount 120 may also include a temperature sensor 130 attached to the sample side 124. A heat shield 132 may be located around the sample side 124 to shield nearby surfaces from heat, provide cover for hot surfaces of the heated sample side, and keep heat from heater 128 concentrated to the sample side within the heat shield. The thermal isolator 126 may be made of a material such that when no heat is applied on the sample side 124, the thermal isolator works as an excellent thermal conductor and provides the sample side 124 at about the same temperature as the cold side 122. When heat is applied to the sample side 124, for example from heater 128, the thermal isolator 126 acts like a thermal insulator and does not allow heat to transfer to the cold side 122. While not limited to a particular material, the thermal insulator 126 may be made of Sapphire. This setup allows sample temperature to be varied in a very wide range of 3K to 800K, or even up to 1000K on the sample under study without damaging the cold side 122. This also eliminates a need for having different testing apparatuses for cryogenic temperatures and higher temperatures.

The length of the flexible interface 48 can be customized as needed for experiments. Orientation of the connection of the flexible interface to the cold-head 100 can also be customized. As an example, the cold-head can be connected at 90 degrees to the axis of the flexible interface, or for that matter any other custom orientation as desired. Accordingly, the scope of the examples includes different possibilities in configurations to suite different experiments. Further, the super-conducting magnet 52 can be oriented in any direction with respect to the axis of the flexible interface 48, as understood by a skilled artisan.

Those skilled in the art will appreciate that other embodiments of the disclosed subject matter may be practiced with many types of cryogenic systems in many different configurations. For example, the multiple flexible interface and multiple targets may be used with a cryostat used with a closed-cycle cooling circuit or with an open-cycle cooling circuit. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A system for cryogenic cooling of a remote cooling target, comprising:

a. a cryostat partially housing a cooling circuit that provides cooled fluid;

b. an interface connected to the cryostat at a proximal end of the interface and extending to a distal end; and c. a target having a housing, the target connected to the distal end of the interface, the target configured to cycle the cooled fluid from the cryostat within the target housing to cool the target to cryogenic temperatures less than 30K;

d. wherein the target is a super-conducting magnet enclosed within a magnet housing, the magnet housing connected to the distal end of the interface; and e. a second interface connected to the cryostat at a proximal end of the second interface and extending to a distal end thereof, and a cold head connected to the distal end of the second interface, the cold head being a second target of the system and configured to hold a test sample, the cold head configured to cycle the cooled fluid from the cryostat within the cold head to cool the cold head and the test sample to cryogenic temperatures less than 30K.

2. The system of claim 1, wherein the cryostat is independently coupled to the super-conducting magnet and the cold-head for independent fluid access to the super-conducting magnet and the cold-head.

3. The system of claim 2, wherein the cold-head is integrated with the super-conducting magnet housing during a first phase when the test sample is concentric within the super-conducting magnet, and the cold-head is separate from the super-conducting magnet housing during a second phase when the test sample is removable from the super-conducting magnet.

4. The system of claim 2, wherein one of the cold head and the super-conducting magnet is cooled to cryogenic temperatures of 20K and below independent of and without affecting temperature of the other one of the cold head and the super-conducting magnet.

5. The system of claim 2, wherein the cold head is heated to 800K independent of and without affecting temperature of the super-conducting magnet.

6. The system of claim 1, further comprising a recirculating compressor connected with the cryostat to form a closed cycle fluid flow circuit.

7. The system of claim 6, further comprising a flow control panel coupled to the recirculating compressor and the cryostat with the flow control panel providing fluid flow between the recirculating compressor and the cryostat.

8. The system of claim 6, further comprising a cryocooler integrated with the cryostat and coupled to a compressor to provide cryogenic cooling to the closed cycle fluid flow circuit.

9. The system of claim 1, wherein vibration introduced by operation of the cryostat for cooling the target is at most one micron in magnitude for measurements of the test sample.

10. The system of claim 1, wherein the second target is configured to permit warming of the test sample held in the second target to room temperature while the second target maintains operation at the cryogenic temperatures less than 30K.

11. A system for cryogenic cooling of a remote cooling target, comprising:

a. cryostat partially housing a cooling circuit that provides cooled fluid;

b. an interface connected to the cryostat at a proximal end of the interface and extending to a distal end; and c. a target having a magnet housing configured to receive a test sample, the target connected to the distal end of the interface, the target configured to cycle the cooled fluid from the cryostat within the target housing to cool the target and a test sample to cryogenic temperatures less than 30K;

d. wherein the target is a super-conducting magnet enclosed within the magnet housing, the magnet housing connected to the distal end of the interface, and the test sample is within a sample chamber shell integrated concentric within the super-conducting magnet and is configured to be temperature controlled independent of the temperature of the super-conducting magnet.

12. The system of claim 11, wherein the interface has a longitudinal axis, and directional orientation of the super-conducting magnet is not limited with respect to the longitudinal axis of the interface.

13. The system of claim 11, wherein the target is configured to permit warming of the test sample held in the super-conducting magnet to room temperature while the target maintains operation at the cryogenic temperatures less than 30K.

14. A remote target for cryogenic cooling of a test sample, comprising:

an interface having a first end and a second end opposite the first end, the first end configured to connect to a cryostat and extend to the second end, the cryostat partially housing a cooling circuit that provides cooled fluid; and a super-conducting magnet unit having a housing configured to receive the test sample, the super-conducting magnet unit connected to the second end of the interface, the super-conducting magnet unit configured to cycle the cooled fluid from the cryostat within the housing to cool the super-conducting magnet unit and the test sample to cryogenic temperatures less than 30K, wherein the super-conducting magnet unit includes a super-conducting magnet, and the test sample is within a sample chamber shell integrated concentric within the super-conducting magnet unit and the super-conducting magnet is configured to be temperature controlled independent of the temperature of the test sample.

15. The remote target of claim 14, wherein the interface has a longitudinal axis, and directional orientation of the super-conducting magnet is not limited with respect to the longitudinal axis of the interface.

16. A remote target for cryogenic cooling of a test sample, comprising:

an interface having a first end and a second end opposite the first end, the first end configured to connect to a cryostat and extend to the second end, the cryostat partially housing a cooling circuit that provides cooled fluid;

a super conducting magnet unit having a housing, the super-conducting magnet unit connected to the second end of the interface, the super-conducting magnet unit configured to cycle the cooled fluid from the cryostat within the housing to cool the super-conducting magnet unit to cryogenic temperatures less than 30K;

a second interface connected to the cryostat at a proximal end of the second interface and extending to a distal end thereof, and a cold head connected to the distal end of the second interface, the cold head configured to hold the test sample, the cold head configured to cycle the cooled fluid from the cryostat within the cold head to cool the cold head and the test sample to cryogenic temperatures less than 30K.

17. The remote target of claim 16, wherein the cryostat is independently coupled to the super-conducting magnet and the cold-head for independent fluid access to the super-conducting magnet and the cold-head.

18. The remote target of claim 16, wherein the cold-head is integrated with the super-conducting magnet housing during a first phase when the test sample is concentric within the super-conducting magnet, and the cold-head is separate from the super-conducting magnet housing during a second phase when the test sample is removable from the super-conducting magnet.

19. The remote target of claim 16, wherein the cold head is configured to permit warming of the test sample held in the cold head to room temperature while the cold head maintains operation at the cryogenic temperatures less than 30K.

20. The remote target of claim 14, wherein the super-conducting magnet unit is configured to permit warming of the test sample held in the super-conducting magnet unit to room temperature while the super-conducting magnet unit maintains operation at the cryogenic temperatures less than 30K.

* * * * *